US007296387B2

(12) United States Patent
Milu

(10) Patent No.: US 7,296,387 B2
(45) Date of Patent: Nov. 20, 2007

(54) ARCHITECTURAL BUILDING PRODUCTS AND METHODS THEREFORE

(76) Inventor: Gregory C. Milu, 19205 SW. 66th St., Pembroke Pines, FL (US) 33332

( * ) Notice: Subject to any disclaimer, the term of this patent is extended or adjusted under 35 U.S.C. 154(b) by 409 days.

(21) Appl. No.: 10/641,794

(22) Filed: Aug. 15, 2003

(65) Prior Publication Data

US 2004/0045239 A1 Mar. 11, 2004

Related U.S. Application Data

(60) Provisional application No. 60/408,757, filed on Sep. 6, 2002.

(51) Int. Cl.
*E04B 2/00* (2006.01)
*E04C 2/38* (2006.01)
*E04F 13/00* (2006.01)
*E04F 19/00* (2006.01)

(52) U.S. Cl. ..... 52/716.4; 52/718.01; 52/718.04; 52/717.03; 52/717.04; 52/311.1; 52/287.1; 52/309.7; 52/309.5

(58) Field of Classification Search .... 52/716.1–716.4, 52/717.01–717.06, 287.1, 288.1, 309.1–309.15; 264/45.1, 46.4, 46.7, 113, 257; 428/221, 428/114, 31, 45, 61, 81; 296/153; 2/267, 2/244

See application file for complete search history.

(56) References Cited

U.S. PATENT DOCUMENTS 4,925,508 A * 5/1990 Goto et al. ..... 156/79
5,330,814 A * 7/1994 Fewell ..... 428/42.2
5,614,307 A * 3/1997 Andersen et al. ..... 428/294.7
5,660,903 A * 8/1997 Andersen et al. ..... 428/36.4
5,665,442 A * 9/1997 Andersen et al. ..... 428/36.4
5,819,485 A * 10/1998 Lane et al. ..... 52/287.1
5,948,505 A * 9/1999 Puppin ..... 428/121
6,475,576 B1 * 11/2002 Ashtiani et al. ..... 428/31
6,481,170 B1 * 11/2002 Savenok et al. ..... 52/288.1
6,966,180 B2 * 11/2005 Deneir et al. ..... 60/327

* cited by examiner

*Primary Examiner*—Jeanette Chapman
(74) *Attorney, Agent, or Firm*—Richard M. Saccocio

(57) ABSTRACT

The present invention comprises architectural building products or "trim" and methods for making, installing and finishing the same. The architectural trim comprises a rigid urethane having a mesh material and or tabs imbedded within the body of the architectural trim product and extending out from the sides thereof for purposes of aiding in the attachment of the architectural trim product to the surface of a building.

15 Claims, 3 Drawing Sheets

ARCHITECTURAL BUILDING PRODUCTS AND METHODS THEREFORE

CROSS REFERENCE TO RELATED APPLICATIONS

This application is related to U.S. provisional application Ser. No. 60/408,757 filed Sep. 6, 2002.

BACKGROUND OF THE INVENTION

1. Field of the Invention

This invention relates in general to the field of architectural building products and in particular to apparatus comprising high density rigid urethane products or trim having a decorative appearance and an architectural shape such as, but not limited to, columns, wainscots, arches, moldings, and wall panels, and methods for making and installing the same.

2. Description of the Prior Art

Architecturally shaped and decorative building products include moldings around the inside and outside of windows, walls, fireplaces, ceilings, and doors. Additionally, such architectural products include columns, wainscots, arches, capitals, bases and caps, pilasters, balustrades, quoins, keystones and other like decoratively shaped objects associated generally with building and other structures. In the trade, these decorative and, in some instances, functional objects are referred to as "trim." In the recent past, these decorative building products or architectural "trim" products were made from materials such as concrete, stone, or plaster. Because of the inherent properties of such materials, the resulting product or object weighed a considerable amount and was subject to breaking from brittle fractures. In turn, the finished product was usually heavy, large and oddly shaped. With some shapes and products, reinforcing materials were used to prevent breakage during handling, transportation, installation and use. But, the reinforcing necessitated more complexity, time, effort, and costs in manufacturing. On-site fabrication was possible for some trim products which minimized handling and breakage problems, but created other manufacturing problems. Thus, regardless of whether the prior art concrete architectural trim products were reinforced, numerous manufacturing problems existed. Handling and installing the prior art concrete architectural trims were yet other problems fraught with difficulties. The heavy weight of the products required substantial supports during installation or attachment to the building structure. Maintaining exact positioning of the prior art concrete trims onto the building structure during installation was also difficult and time consuming because of the heavy weight of the concrete and the sometimes odd configuration of the architectural trims. Moreover, positioning and installation of the prior art concrete trim products most often required hand labor in that specialized machinery was generally not available. Therefore, and in general, architectural building and decorative trim products made from concrete and plaster have been problematic, to say the least.

Many of the above-stated problems and difficulties were resolved by the use of expanded polystyrene for the architectural shapes in place of the prior art use of concrete. Expanded polystyrene can be fabricated using inexpensive and easily fabricated molds. Expanded polystyrene is lightweight and therefore relatively easily handled; it is soft and therefore relatively easily cut. Expanded polystyrene is readily attachable to typical building surfaces using an appropriate adhesive. Of course, expanded polystyrene architectural trims cannot normally be used as supporting structures, and its softness makes the foam subject to damage by conditions that would not affect concrete. Still, expanded polystyrene has sufficient advantages over concrete such that it is being used in the prior art for non-structural, decorative and architectural trims in the building trade.

The light weight of expanded polystyrene is an advantage that makes installation onto a building less difficult than concrete (or stone, or plaster, or metal, or any other hard and dense material). In the prior art, a typical installation of a expanded polystyrene architectural trim included attaching the trim to a wall by a construction adhesive or by mechanical fasteners or by a combination of the two. Further finishing and or attachment of the prior art expanded polystyrene trims may then occur by use of a mesh material applied over the attached trim, by use of a sprayed material that thereafter becomes hardened, or left as applied in its uncoated condition, with final finishing being accomplished by painting or by the application of a stucco finish and then painted. The desired final appearance in the existing prior art is usually, but not necessarily, different from that of the building structure in order to accent the architectural shape and distinguish it from the rest of the building or for accent purposes.

The use of expanded polystyrene has shown the viability of replacing architectural trim that typically was made from a concrete or stone, with a lightweight plastic. Still, expanded polystyrene is not without its own problems—due mainly to its inherent properties. Expanded polystyrene is time consuming to manufacture and install and is not durable. It is not subject to fine detailing; and, therefore, results in a rather coarse appearing decorative trim. The finishing procedure is both difficult and time consuming and at times, the resulting appearance is undesirably distinguishable from the building structure and not as intended. Once installed, the expanded polystyrene trim is subject to impact damage and weathering. Because of its tendency to be damaged, expanded polystyrene cannot be used for any application where impact accidents are expected to occur or where frictional contact with another object is common. Moreover, repair of damaged expanded polystyrene is difficult and often the repaired results are not satisfactory in that the repair is readily visible. As a result, its use is rather limited.

Thus, while expanded polystyrene provided advances to the prior art of architectural shapes and trims, it did not provide a complete solution. What is needed are apparatus and methods that allow the use of lightweight plastic for architectural shapes, trims and even walls, that have the capability of providing fine details, that allow for finishes that accent or distinguish the architectural shapes from the rest of the building, or that match the building, that provide finishes that are virtually identical to the finishes and appearances of products found in nature, that resist damage even when subject to abuse, that are durable over a long period of time, that are not adversely affected by weather, that give the appearance of concrete or other like material, that give the appearance of being an integral part of the building, that can be used internally and externally, and are easy to install and finish.

The present invention accomplishes these objectives.

SUMMARY OF THE INVENTION

The above-stated objects as well as other objects which, although not specifically stated, but are intended to be included within the scope the present invention, are accomplished by the present invention and will become apparent from the hereinafter set forth Detailed Description of the Invention, Drawings and Claims, appended herewith.

The present invention comprises architectural building products or "trim" and methods for making, installing and finishing the same. The architectural trim comprises a rigid urethane having a mesh material and or tabs imbedded within the body of the architectural trim product and extending out from the sides thereof for purposes of aiding in the attachment of the architectural trim product to the surface of a building. The architectural trim is provided with any one of a virtually unlimited number of surface finishes or textures, natural and unnatural, at the time it is manufactured. The configurational shape of the trim is likewise unlimited. A combination of the density of the rigid urethane and in some instances, the thickness of the surface finish, provides for trim products that can be tailored to function in accordance with their end use, environment, and desired appearance. The architectural trim is adhesively attached to the surface of the building structure with the mesh material extending from the sides thereof and flat against the building surface. Mechanical fasteners can also be used to temporarily support the weight of the trim while the adhesive fully sets up. To further attach the architectural trim to the building surface, a mixture of cement and polymer is placed under the mesh such that the mesh can thereafter be imbedded in the cement based mixture and allowed to harden. A finishing material, such as plaster or stucco is applied over the imbedded mesh at the same time as the stucco is applied to the building structure. The use of the architectural trim products provided by the present invention is not limited to new buildings. Indeed, updating, refurbishing, or redecorating previously existing buildings can benefit for the use of the present invention In accordance with the above, there has been summarized the more important features of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure. Additionally, the verbiage used herein is intended to better enable a person to understand the invention and therefore, such verbiage is not to be interpreted as limiting the invention.

Figure 1:
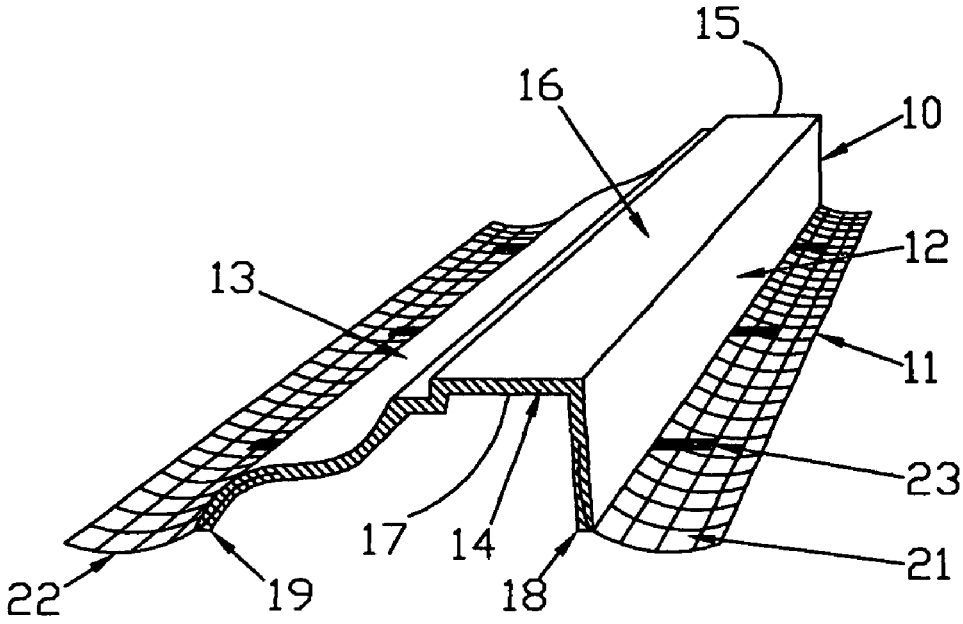
FIG. 1 is a perspective view of one form of the architectural trim product as it may assume in practice, with FIGS. 1A and 1B illustrating variations of the embodiment of FIG. 1.

Reference is now made to the drawings, wherein like the characteristics and features of the present invention shown in the various figures are designated by the same reference numerals. FIG. 1 illustrates one embodiment of the invention comprising an architectural trim product 10 according to the present invention having a uniform cross sectional density and made from a rigid urethane or any other suitable rigid light weight plastic. In FIG. 1, the architectural trim 10 can comprise a molding, a wainscot, arch, or any decorative or functional trim that is to be applied to the surface of a structure, either inside or outside, or can comprise a faux structural element such as a column or a beam. Hence, the shape and the function of the trim product shown in the Figures are not limited to that shown or described; rather, those shown and described are merely representative of a typical architectural trim product made and installed in accordance with the teachings herein.

A mesh material 11, made for example from fiberglass and having a plurality of openings, in the approximate range of ⅛ to ¼ inches square, through the material, is embedded within the architectural trim 10 and extends an appropriate distance from either side thereof. Mesh material 11 can extend the full length and width of the architectural trim 10, or it can consist of a plurality of discrete strips spaced along the length of the architectural trim 10. The distance that the mesh material 11 extends from either side of the architectural trim 10 is variable but should be such that sufficient support is provided to the installed trim and such that it can be blended onto the structure surface. Additionally, if desired, the mesh material 11 can extend from one side 12 or 13 only of trim 10, can alternating from one side 12 to the other side 13 of trim 10, or extend from all both sides 12 and 13 and both ends 14 and 15 of the architectural trim 10. Moreover, the mesh material can be a single piece imbedded across the entire width of the trim 10, on can be separate pieces, each being placed on opposite sides of the architectural trim 10 along the length thereof, or the mesh material can be spaced along the length of trim 10 with or without spaces therebetween. The placement of the portion of the mesh material 11 within the body of the architectural trim 10 is also not fixed. The main consideration being that the mesh material is securely imbedded and, therefore, fixedly attached to the architectural trim 10. For example, all or a portion of the mesh material 11 contained within the body of the architectural trim 10 can be biased, in any amount, toward the top surface 16 or toward the bottom surface 17 of the architectural trim 10, provided that the mesh material 11 does not show through the top surface 16. Yet another consideration of the placement of the mesh material 11 is that it extend substantially from the underside surfaces 18 and 19 of the architectural trim 10 so as to allow the extending portions 21 and 22 of the mesh material 11 to fit flat up against the surface of the building structure. Accordingly, the imbedded mesh material 11 can exit from the body portion of the architectural trim 10 in close proximity to the outside corners of the underside surfaces 18 and 19. Although somewhat less desirable, the mesh material 11 can even exit from the body of the architectural trim 10 at a location along the side surfaces 12 and 13 in close proximity to the corner formed by the intersection of side 12 with underside surface 18 and the corner formed by the intersection of underside surface 19 and side surface 13. All of these considerations are well within the knowledge and capability of one skilled in the art and essentially no experimentation is required.

In another variation shown in FIG. 1, one or more tabs 23, made from an appropriate strip of metal or plastic, can be imbedded within the body of the architectural trim 10 and extend from the sides thereof 12 and 13 an appropriate distance so as to allow a mechanical fastener to be used to attach the tabs 23 to the surface of the structure. If desired, a combination of tabs 23 and mesh material 11 can be used to attach the architectural trim 10 to the surface of a building structure. The location and spacing of the tabs 23 are optional. The tabs 12 can serve a useful role to support the weight of the architectural trim while the adhesive applied to the back of the architectural trim sufficiently sets to support the weight.

Figure 1A:
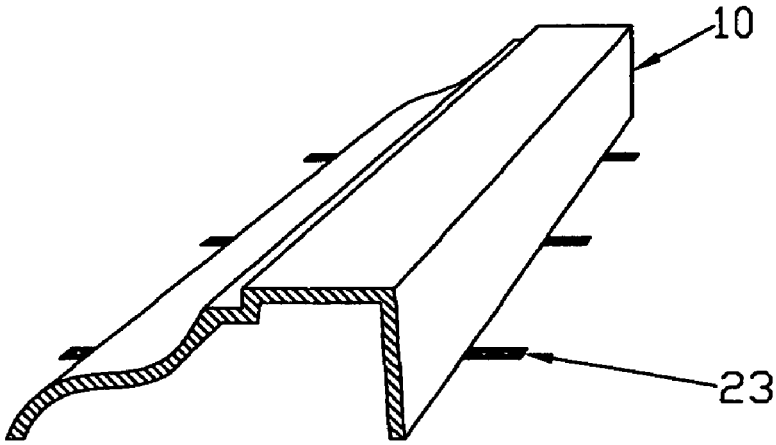
Figure 1B:
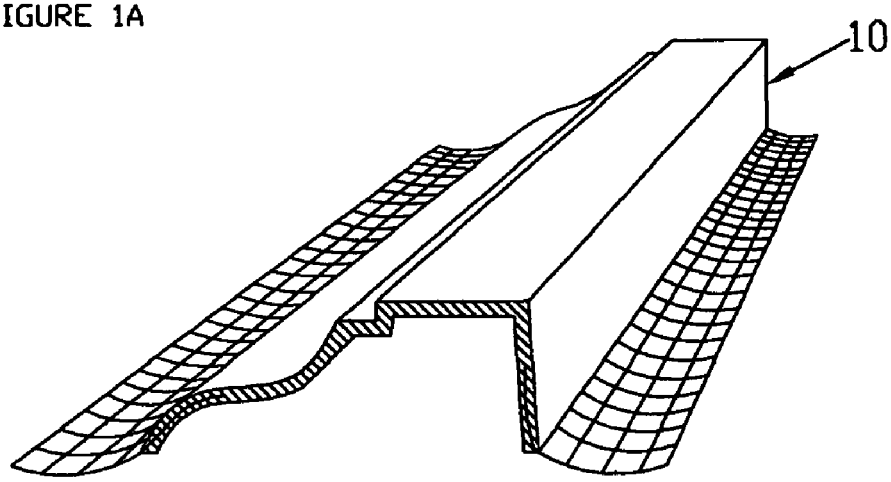

FIG. 1A illustrates the architectural trim 10 using only tabs 23. FIG. 1B illustrates the architectural trim 10 using only the mesh material 11.

The outside surface 16 of the architectural trim 10 can be configured to resemble virtually any texture that is desired by the building designer. For example, it may have a stucco finish, a plain smooth finish, a concrete-like finish, etc., and, if desired, can be sculpted or embossed with geometric or other decorative designs. All of such surface finishes can be obtained by appropriately configuring the inside surface of the mold used to form the trim 10. The underside surface 17 can also be shaped as desired but without a decorative finish inasmuch as the under surface 17 is not exposed to view when the architectural trim 10 is installed. Thus, the underside surface 17 can be flat across the entire width and length of the trim 10, or can be provided with cutouts, hollow depressions, or grooves. One consideration being the amount and type of surface area needed to provide a permanent attachment to the building structure in conjunction with the support provided by the extending mesh material 11 and or tabs 23. Other considerations include the desired rigidity of the trim 10, the size and weight of the trim 10 and even the type of trim 10 to be used. The ability of the present invention to vary in density and to vary in the treatment of the back surface provides for a finished product that allows an architect virtually limitless design choices in the type of trim 10 to be incorporated in the design of a new building or refurbishing of an older building. Moreover, all of the aforementioned architectural and structural considerations are known in the prior art and consistent with known industry practices.

The present invention contemplates the following process for manufacturing the architectural trim 10. A female mold is made having an internal shape corresponding to the finished outside shape 16 of a particular architectural trim 10. The mold may be made from silicon using standard prior art techniques. A cover is made having the finished shape of the underside 17 of the architectural trim 10. The mold is brought up to an appropriate temperature consistent with the plastic material such as urethane, from which the architectural trim 10 is to be fabricated. A predetermined amount of plastic material is introduced into the mold 11. The determination of the predetermined amount of urethane being calculated in accordance with industry standards for the particular architectural trim 10 being made and the desired density of the finished product. The urethane is then wetted out in accordance with industry standards. The mesh material 11 is positioned within the mold with an appropriate portion extending out from the side edges of the mold. The mesh 11 being in accordance with the above description. If used, tabs 23 are positioned and the cover or lid is then placed on the mold. Pressure is applied while the plastic material is expanding and curing. The pressure also contributes to the finished density of the architectural trim 10. It is preferable that the mesh material 11 be positioned such that it is directed away from any flashing that may occur from the combination of amount of applied pressure and the clearance between the lid and the mold in order to keep the openings in the mesh free of the plastic material. After the plastic material is fully cured, and the temperature is reduced, the finished product having the mesh material 11 and tabs 12, if used, imbedded therewithin can be removed from the mold. Forming a suitable plastic material for trim 10 such as foamed rigid urethane is well known in the art and therefore the described procedure is not intended to comprise a detailed step by step description.

Figure 2:
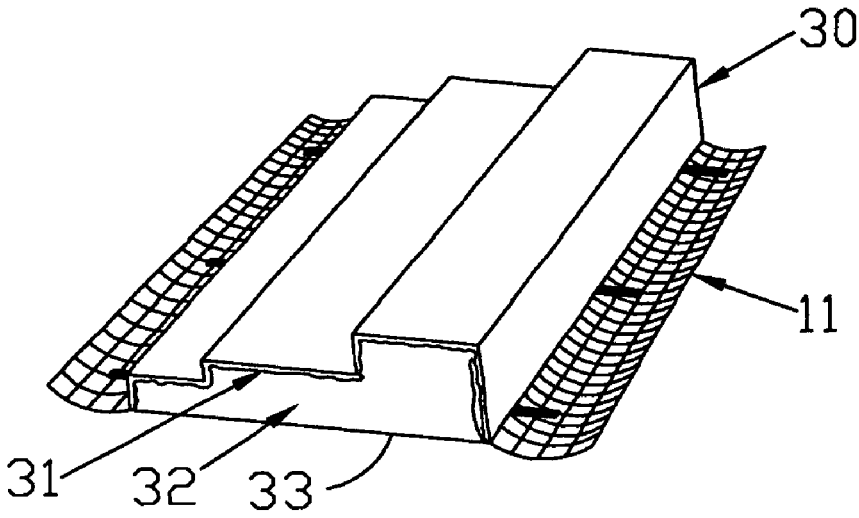
FIG. 2 is a perspective view of another embodiment of the architectural trim product according to the present invention and as it may assume in practice with FIGS. 2A and 2B illustrating variations of the embodiment of FIG. 2; and, FIG. 3 is a one method used to secure the architectural trim product of FIG. 1 or 2 to a surface of a building structure.

FIG. 2 illustrates another embodiment of an architectural trim 30 as it may assume in the practice of the invention. The outside surface 31 of trim 30 is provided with a relatively hard coating such that it is not adversely affected by heavy traffic, occasional hard impacts, and or weather conditions. The interior 32 of trim 30 comprises a plastic such as rigid urethane having a relatively low density as compared to the density of trim 10. The back surface 33 can be full and without the need to include voids or formed as previously described. The combination of a hard outer surface 31 and a low density foamed interior 32 provides trim 30 with an overall light weight but a very hard outer surface 31. Trim 30, is therefore suitable for wall panels and even moldings that are subject to impact loads e.g. chair rails. Such suggested uses, of course, are not intended to be limiting.

The architectural trim 30 is manufactured in a manner somewhat similar to the prior embodiment comprising architectural trim 10, that is, it is cast using an appropriate mold, temperature and pressure. In this embodiment, the surface coating 31 comprising, for example, a rigid urethane plastic having a density of twenty, or more, pounds per cubic foot is applied to the interior of the mold to achieve a finished thickness in the range of approximately ⅛ to ½ of an inch. A lesser or a greater thickness is also satisfactory; the object being to provide trim 30 with a hard, weather resistant, impact resistant, and long lasting outer surface. A rigid urethane plastic having a density of approximately 4 to 6 pounds per cubic foot is applied to the hard coating and allowed to cure. In this embodiment, the back surface 33 can also be solid or provided with cutouts or voids.

Mesh material 11 is imbedded within the rigid urethane during the molding process as in the previous embodiment. In prototype testing, an open weaved treated glass fiber mesh having a weight of 4.3 ounces per square yard and a tensile strength of 150 PLI was determined to work satisfactorily. In the same testing, imbedding the mesh a distance of approximately four (4) inches into the rigid urethane and extending out a similar distance of four (4) inches from the edges of the trim proved to be satisfactory. Of course, these distances are approximate and may be increased or even decreased depending, for example, on the width and weight of the architectural trim 30. The location and amount of mesh material 11 and the tabs 23 in the embodiment of FIG. 2 may vary as described in FIG. 1. The primary difference between the embodiments of FIGS. 1 and 2 being the make up of the plastic material used to make the body of the architectural trims.

Figure 2A:
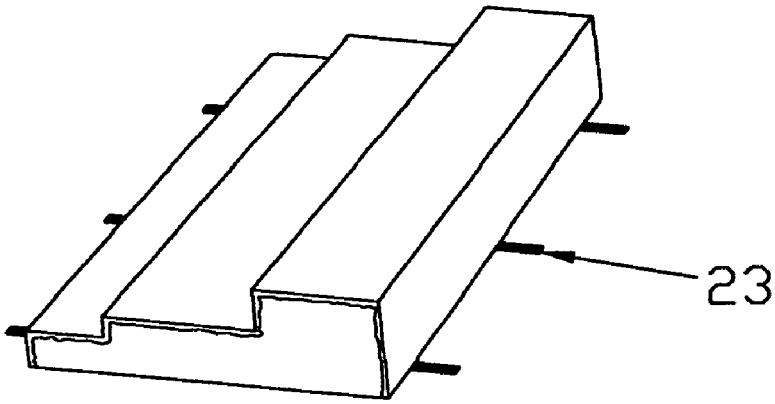
Figure 2B:
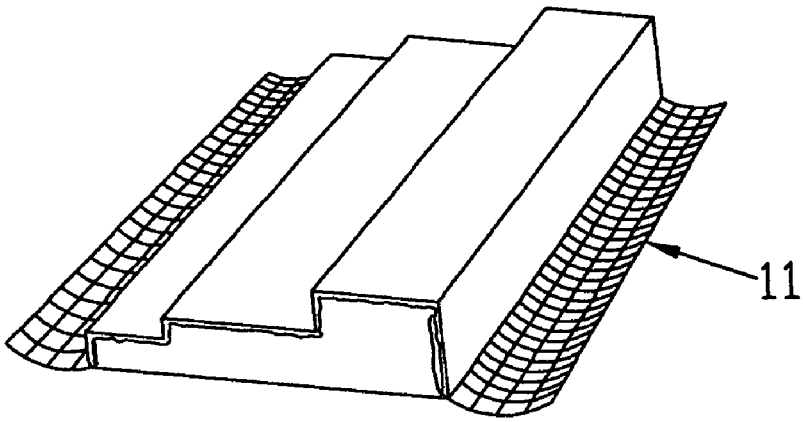

FIG. 2A illustrates the architectural trim 10 using only tabs 23. FIG. 2B illustrates the architectural trim 10 using only the mesh material 11.

Figure 3:
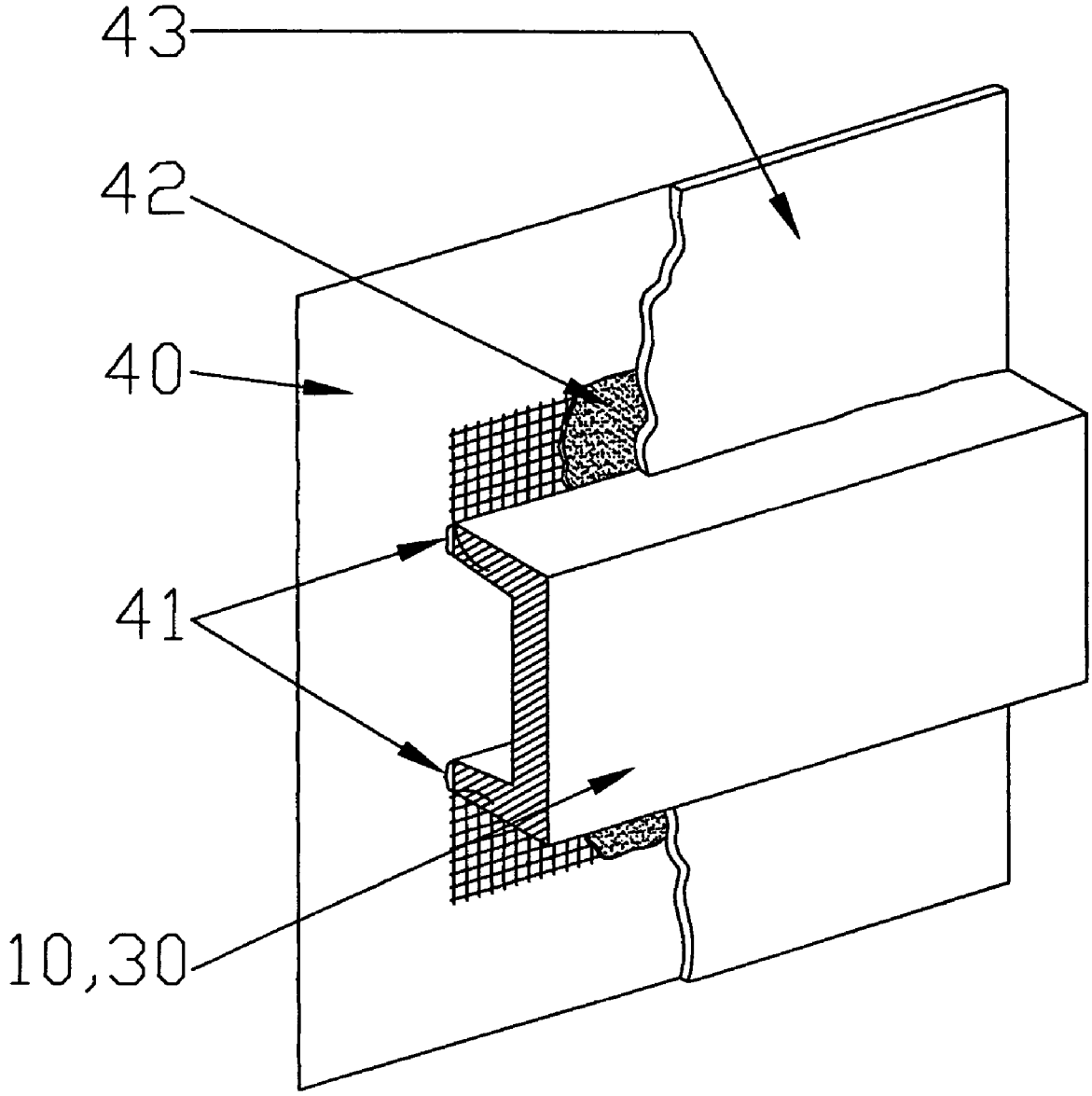

FIG. 3 shows one method used to secure the architectural trim 10 or 30 to a surface of a building structure 40. A conventional construction adhesive 41 is applied to the under surface of the architectural trim 10, 30 which is then placed in position on the building structure 40. Mechanical fasteners can be used at this time to secure the tabs 23 (FIGS. 1 and 2) to the building surface 40. Care is taken to assure that the mesh material 11 extends from the sides thereof and is not otherwise folded under the underside of the architectural trim 10, 30. Trimming of any excess mesh 11 may be accomplished at this time and the remaining mesh 11 may be checked to assure that it otherwise follows the contours of the structure. When the adhesive applied to the back of trim 10, 30 has cured, the mechanical fasteners can be removed. A cementitious material 42 (a mixture of cement and a liquid polymer, for example) is applied on the structure 40 and under the mesh 11. The mesh 11 is pressed into the layer of the cementitious material 42 and troweled over to cover any exposed portions of the mesh 11 and to feather in the edges of the cementitious material 42. Finally, a finishing material 43, such as plaster or stucco is applied over the mesh 11 and trim 10, 30 to blend the attachment of the architectural trim 10, 30 with the surface 40 of the building and to give the appearance that the architectural product 10, 30 is part of the building and not just glued thereon. A coat of paint completes the installation.

Attachment of the back of the architectural trim 10, 30 to the surface 40 of the structure was successfully accomplished using a premium polyurethane adhesive 41. The type and class of sealant however, is a necessary element of the invention. Once the adhesive 41 is applied, the architectural trim 10, 30 is pressed against the surface 40 of the structure and held in place until such time as the adhesive has sufficiently hardened to support the weight of the architectural trim 10, 30. Any type of known temporary support may be used to hold the shape or trim in place while the adhesive is curing, for example, an appropriate tape applied to the mesh 11 or a removable mechanical fastener in conjunction with tabs 23.

A resulting thickness of the cement based mixture 42 of approximately ¼ inch works satisfactory. Depending upon the finish, texture and color chosen for the finished architectural trim 10, 30, it may not be necessary to apply any finish other than paint, to the installed architectural trim 10, 30. For example, where the trim 10, 30 comprises wall tiles having the appearance of coral, no additional finish is necessary. In this instance, the interior surface of the molds used to make the tiles would be exact mirror images of quarried, sliced and polished coral and the color of the hard surface would be off-white.

In accordance with the above, there is disclosed and described a unique and novel architectural trim product and the method of making installing the same that significantly advances the art of architectural embellishments or trim pieces to building structures.

For example, the trim product provided by the invention: can comprise a medium to high density rigid urethane having a normally resulting smooth surface; can comprise a low-density rigid urethane having a hard and textured surface finish; can comprise a high-density rigid urethane having a smooth or textured surface; or, any combination of the same in an unlimited array of shapes and sizes.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breath and scope of the drawings and description provided herein.

I claim:

1. Architectural trim apparatus and a building comprising in combination:

said architectural trim apparatus having a body portion made from a foamed plastic, said body portion having opposite side edges and an underside surface; and a mesh material imbedded within the body portion of the trim and extending out from the body portion at an approximate location of a junction of the underside surface and a side edge, said mesh also extending a distance along a length of said at least one side edge, said building having a surface thereon, said body portion's underside surface being in contact with said building surface, said extending mesh material being attached to said building surface.

2. The architectural trim of claim 1, wherein said body portion comprises a foamed plastic having an approximate single density.

3. The architectural trim of claim 1, wherein said body portion comprises a foamed plastic having a first density and a second density, said first density being greater than the second density, said first density being generally located at an outside surface of said architectural trim.

4. The architectural trim of claim 1, wherein said mesh material comprises one or more tabs extending out approximately from said junction location.

5. The architectural trim of claim 1, wherein said body portion includes an outer surface, said under surface being configured at least in part, to fit against the surface of said building, said outer surface having an architectural trim configuration.

6. The architectural trim of claim 1, wherein said imbedded mesh material exits from and extends some distance along said underside surface before extending out from said junction.

7. The architectural trim of claim 1, wherein said imbedded mesh material exits from said underside surface of said body portion.

8. The architectural trim of claim 1, wherein said foamed plastic comprises a urethane.

9. Architectural trim apparatus and a building comprising in combination:

said architectural trim apparatus having a body portion made from a foamed plastic, said body portion having opposite side edges and an underside surface; and one or more tabs imbedded within the body portion of the trim and extending out approximately from a junction of said at least one side edge and said underside surfaces, said building having a surface said body portion's underside surface being in contact with said building surface, said one or more tabs being attached to said building surface.

10. The architectural trim of claim 9 wherein said plastic foam comprises a urethane.

11. Architectural trim apparatus and a building comprising in combination:

said architectural trim apparatus having a body portion made from a foamed plastic, said body portion having opposite side edges and an underside surface; and a mesh material imbedded within the body portion of the trim and extending out from said body portion, said mesh also extending a distance along a length of said side edges, wherein said imbedded mesh material extends from said body portion in close proximity to a junction of said at least one side edge and said underside surface, a surface on said building said body portion's underside surface being in contact with said building surface, said extending mesh material being attached to said building surface.

12. The architectural trim of claim 11 wherein said plastic foam comprises a urethane.

13. The architectural trim apparatus and a building of claim 1 wherein said underside surface is attached to said building surface.

14. The architectural trim apparatus and a building of claim 9 wherein said underside surface is attached to said building surface.

15. The architectural trim apparatus and a building of claim 11 wherein said underside surface is attached to said building surface.

* * * * *